US009532426B2

(12) United States Patent
Wen et al.

(10) Patent No.: US 9,532,426 B2
(45) Date of Patent: Dec. 27, 2016

(54) ADJUSTMENT METHOD FOR LED BACKLIGHT BRIGHTNESS

(71) Applicant: SHENZHEN TCL NEW TECHNOLOGY CO., LTD., Guangdong (CN)

(72) Inventors: Dong Wen, Guangdong (CN); Jianshe Qin, Guangdong (CN); Jianqiang Li, Guangdong (CN); Yong Yang, Guangdong (CN); Haiying Zhang, Guangdong (CN); Dexiang Zuo, Guangdong (CN)

(73) Assignee: Shenzhen TCL New Technology Co., Ltd., Guangdong (CN)

( * ) Notice: Subject to any disclaimer, the term of this patent is extended or adjusted under 35 U.S.C. 154(b) by 0 days.

(21) Appl. No.: 14/894,427

(22) PCT Filed: Jan. 15, 2014

(86) PCT No.: PCT/CN2014/070673
§ 371 (c)(1),
(2) Date: Nov. 27, 2015

(87) PCT Pub. No.: WO2015/010456
PCT Pub. Date: Jan. 29, 2015

(65) Prior Publication Data

US 2016/0119997 A1 Apr. 28, 2016

(30) Foreign Application Priority Data

Jul. 22, 2013 (CN) ..... 2013 1 0309269

(51) Int. Cl.
*H05B 41/16* (2006.01)
*H05B 33/08* (2006.01)
*G09G 3/34* (2006.01)

(52) U.S. Cl.
CPC ..... *H05B 33/0851* (2013.01); *G09G 3/3406* (2013.01); *H05B 33/0845* (2013.01); *G09G 2320/062* (2013.01); *G09G 2320/064* (2013.01)

(58) Field of Classification Search
CPC ..... H05B 33/0851; H05B 33/0845; G09G 3/3406; G09G 2320/064; G09G 2320/062
(Continued)

(56) References Cited

U.S. PATENT DOCUMENTS

2008/0055196 A1* 3/2008 Izumida ..... G09G 3/32 345/46
2010/0219764 A1* 9/2010 Yamasaki ..... H05B 33/0851 315/224

FOREIGN PATENT DOCUMENTS

CN 101137262 A 3/2008
CN 101836505 A 9/2010

* cited by examiner

*Primary Examiner* — Daniel D Chang
(74) *Attorney, Agent, or Firm* — Rosenberg, Klein & Lee

(57) ABSTRACT

An adjustment method for LED backlight brightness, comprising the following steps of: if the current LED backlight brightness is greater than a preset value, maintaining the PWM duty ratio as the maximum value, and adjusting the LED backlight brightness by adjusting an LED conduction current (S10); and if the current LED backlight brightness is not greater than the pre-set value, maintaining the LED conduction current to be constant, and adjusting the LED backlight brightness by adjusting the change of the PWM duty ratio between the maximum value and the minimum value (S20). This method can improve the light-emitting efficiency of LEDs, reduce backlight loss, and reduce the noise generated by an LED drive circuit.

13 Claims, 3 Drawing Sheets

ADJUSTMENT METHOD FOR LED BACKLIGHT BRIGHTNESS

TECHNICAL FIELD

The present disclosure relates to a liquid crystal display television (LCD TV), and particularly to an adjustment method for LED backlight brightness.

DESCRIPTION OF RELATED ART

At present, LED backlight brightness of an LCD TV is usually adjusted by PWM dimming, i.e., keeping current passing through LED lamps constant and changing duty ratio of PWM wave to change turn-on time and turn-off time of LED lamps in a backlight strip correspondingly, so as to achieve the purpose of adjusting the backlight brightness. When the duty ratio of the PWM wave is 100%, the backlight strip is always on, which corresponds to the maximum backlight brightness of the TV. The backlight is brightness is gradually decreased with gradual reduction of the duty ratio of the PWM wave. However, the PWM dimming has the following shortcomings: 1. the current passing through the LED lamps is fixed to a current that corresponds to a maximum brightness, which causes a lower LED luminous efficiency and a larger backlight loss; 2. when the current passing through the LED lamps is fixed to a current that corresponds to a maximum brightness if the signal frequency of PWM belongs to a range within human hearing frequency i.e. 100 Hz to 20 kHz, an inductor and an output capacitance around an LED drive circuit may produce large noise.

BRIEF SUMMARY OF THE DISCLOSURE

A main object of the present disclosure is to provide an adjustment method for LED backlight brightness, which can improve the LED luminous efficiency, decrease backlight loss, and reduce noise generated by the LED drive circuit.

An adjustment method for LED backlight brightness provided in the present disclosure includes the following steps:

when current LED backlight brightness is greater than a preset value, maintaining PWM duty ratio to be a maximum value, and adjusting the LED backlight brightness by adjusting an LED conduction current; and when the current LED backlight brightness is not greater than the preset value, maintaining the LED conduction current to be constant, and adjusting the LED backlight brightness by adjusting the PWM duty ratio to be changed between the maximum value and a minimum value.

Preferably, the preset value is any value within a range of 36%~84% of the maximum brightness of the LED backlight.

Preferably, the maximum value of the PWM duty ratio is a value within a range of 80%~100%.

Preferably, the preset value is a brightness value of the LED backlight corresponding to the LED conduction current which is at a predetermined value, and the predetermined value of the LED conduction current is determined by variation characteristics of LED chromaticity coordinate and luminous efficiency.

Preferably, the predetermined value of the LED conduction current is any value within a range of 30%~80% of the maximum value of actual LED conduction current.

Preferably, the predetermined value of the LED conduction current is 42% of the maximum value of actual LED conduction current.

Preferably, the preset value is any value within a range of 36%~84% of the maximum brightness of the LED backlight.

Preferably, the preset value is 48.3% of the maximum brightness of the LED backlight.

Preferably, the step of said when the current LED backlight brightness is greater than a preset value, maintaining PWM duty ratio to be a maximum value, and adjusting the LED backlight brightness by adjusting an LED conduction current comprises:

if the current LED backlight brightness is greater than the preset value, when increasing the LED backlight brightness to the maximum brightness, maintaining the PWM duty ratio to be the maximum value, and increasing the LED conduction current to the maximum value of actual LED conduction current; and when reducing the LED backlight brightness to the preset value, maintaining the PWM duty ratio to be the maximum value, and reducing the LED conduction current to the preset value of the conduction current.

Preferably, the maximum value of the PWM duty ratio is a value within a range of 80%~100%.

Preferably, the minimum value of the PWM duty ratio is a value within a range of 0%~30%.

Preferably, the step of said when the current LED backlight brightness is not greater than the preset value, maintaining the LED conduction current to be constant, and adjusting the LED backlight brightness by adjusting the PWM duty ratio to be changed between the maximum value and a minimum value comprises:

if the current LED backlight brightness is not greater than the preset value, when reducing the LED backlight brightness to the minimum brightness, maintaining the LED conduction current to be the predetermined value of the conduction current, and reducing the PWM duty ratio to the minimum value; and when increasing the LED backlight brightness to the preset value, maintaining the LED conduction current to be the predetermined value of the conduction current, and increasing the PWM duty ratio to the maximum value.

Preferably, the minimum value of the PWM duty ratio is a value within a range of 0%~30%.

Comparing with the prior art, the adjustment method for LED backlight brightness in the present disclosure allows the LED conduction current not always keep at the maximum value by means of choosing PWM dimming or conduction current dimming according to the current LED backlight brightness, which greatly improves the LED luminous efficiency and reduces backlight loss. Moreover, the conduction current dimming (i.e. analogue dimming) is adopted when the LED backlight brightness is greater than the preset value. The analogue dimming can make the LED drive circuit avoid producing noise; and when the LED backlight brightness is not greater than the preset value, PWM dimming is adopted, in such case, the LED conduction current is at the preset value rather than the maximum value, which can also make the LED drive circuit avoid producing noise.

The implementations, functional features and advantages of the present disclosure will be further described with reference to embodiments thereof and the accompanying drawings.

DETAILED DESCRIPTION

It should be appreciate that, the embodiments described herein e only intended to illustrate but not to limit the present disclosure.

Figure 1:
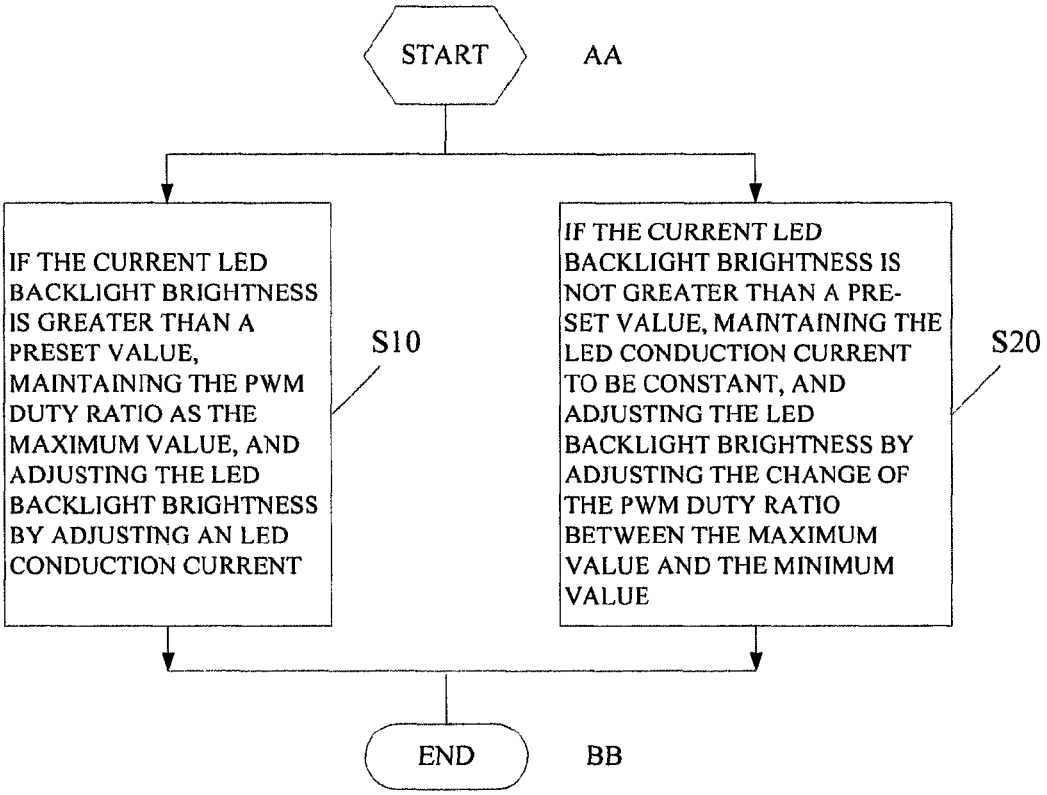
FIG. 1 is a schematic flow chart of an embodiment of an adjustment method for LED backlight brightness according to the present disclosure.
Figure 2:
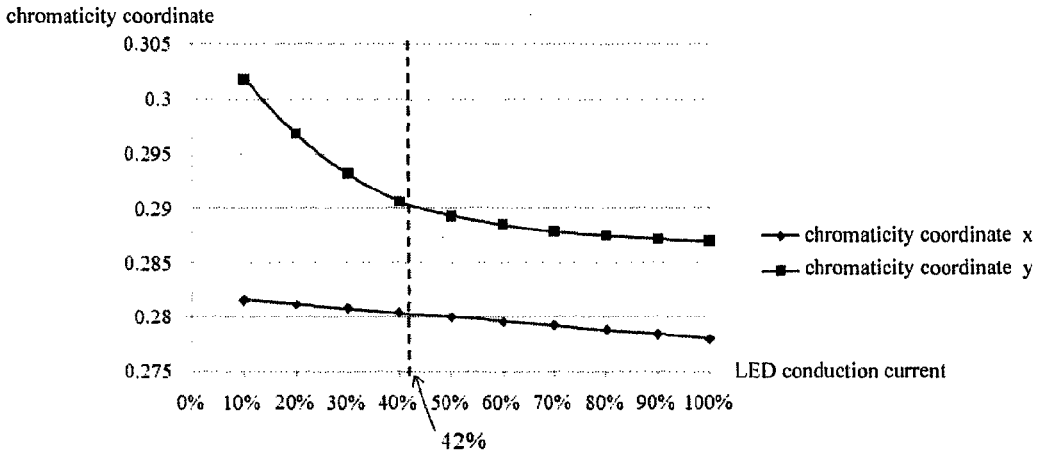
FIG. 2 is a graph showing variation characteristics of LED chromaticity coordinate.
Figure 3:
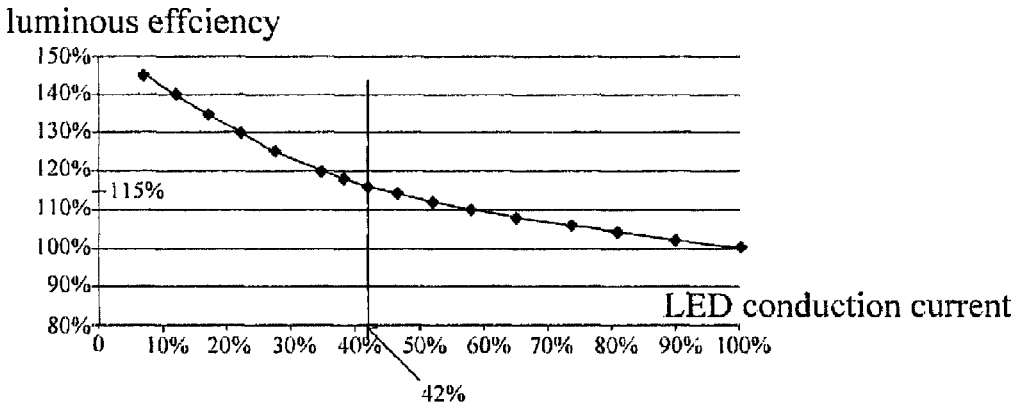
FIG. 3 is a graph showing variation characteristics of LED luminous efficiency.

Referring to FIG. 1 to FIG. 3, FIG. 1 is a schematic flow chart of an adjustment method for LED backlight brightness of an embodiment of the present disclosure; FIG. 2 is a graph showing the variation characteristics of chromaticity coordinate of LED; and FIG. 3 is a graph showing the variation characteristics of LED luminous efficiency.

An adjustment method for LED backlight brightness provided in the embodiment includes:

a step S10, when current LED backlight brightness is greater than a preset value, maintaining PWM duty ratio to be a maximum value, and adjusting the LED backlight brightness by adjusting an LED conduction current;

In the embodiment, the maximum value of PWM duty ratio is preferably selected to be 100% or 99%, and can be any value within a range of 80%~100%.

The preset value is a brightness value of the LED backlight corresponding to the LED conduction current which is at a predetermined value, and the predetermined value of the LED conduction current is determined by variation characteristics of LED chromaticity coordinate and luminous efficiency. The criteria about the determination is not only improving the luminous efficiency, but also not changing the chromaticity coordinate too greatly so as to avoid affecting image quality.

FIG. 2, a rated current is obtained when the LED conduction current is 100%. As shown in FIG. 2 and FIG. 3, with reduction of the LED conduction current, the LED luminous efficiency will be increased, and the change of the chromaticity coordinate x is small while the chromaticity coordinate y will become significantly high when the conduction current is lower than 42% of the maximum value of actual LED conduction current (herein assuming that the maximum value of actual LED operating conduction current equals to the LED rated current). As can be seen from FIG. 2, when the LED conduction current is changed between 100%~42% of the maximum value of actual LED conduction current, the changes of the chromaticity coordinates x and y about the overall backlight strip are small. specifically, the chromaticity coordinate x is almost unchanged and the variation of the chromaticity coordinate y is smaller than 0.003. which is a very small change and may not affect visual quality. When the conduction current is further reduced from 42%, the change of the chromaticity coordinate y quicken remarkably, and start to affect the visual quality apparently. Therefore, in the embodiment, the predetermined value of LED conduction current is 42% of the maximum value of actual LED conduction current; in such case, as can be seen from FIG. 3, the LED luminous efficiency is 115%, and the preset value of backlight brightness is 48.3% of the maximum brightness of LED backlight, which can be obtained by calculating 42%*1.15=48.3%.

However, under the condition that the maximum value of actual LED conduction current equals to the LED rated current, since the variation characteristics of chromaticity coordinate varies with different LEDs, the predetermined value of the conduction current may be different (e.g. probably 41%, 43%, etc.), and the preset value of the backlight brightness may accordingly be varied with the variation of the predetermined value of the conduction current. Furthermore, the foregoing 42% is set under the condition that the maximum value of actual LED conduction current equals to the LED rated current, in view of the maximum value of actual LED conduction current being probably greater or less than the LED rated current (e.g. 1.2 times the rated current or 0.5 times the rated current). For example, the maximum value of actual LED conduction current may be 60% of the LED rated current, at this point, the predetermined value of the LED conduction current is selected to be 42% of the LED rated current, which actually 70% of actual LED conduction current. Therefore, dependent on different situations, the predetermined value of the LED conduction current can be a value selected from a range within 30%~80% of actual LED conduction current. Accordingly, the preset value of the backlight brightness can appropriately be a value selected from a range within 36%~44% of the maximum brightness of the LED backlight.

In the step S10, the adjustment of the LED backlight brightness includes the following two situations, i.e., increasing the LED backlight brightness to the maximum brightness and reducing the LED backlight brightness to the preset value:

First, increasing the LED backlight brightness to the maximum brightness:

Under such situation, maintaining the PWM duty ratio to be the maximum value, and increasing the LED conduction current to be the maximum value of actual LED conduction current, thus increasing the LED backlight brightness from the current LED backlight brightness to the maximum brightness.

Second, reducing the LED backlight brightness to the preset value:

Under such situation, also maintaining the PWM duty ratio to be the maximum value, and reducing the LED conduction current to the predetermined value of the conduction current, thus reducing the LED backlight brightness from the current LED backlight brightness to the preset value.

In a step S20, when the current LED backlight brightness is not greater than the preset value, maintaining the LED conduction current to be constant, and adjusting the LED backlight brightness by adjusting the PWM duty ratio to be changed between the maximum value and a minimum value. The minimum value of the foregoing PWM duty ratio is preferably selected to be 10%, and can be any value within a range of 0%~30%.

In the step S20, the adjustment of LED backlight brightness include the following two situations, i.e., reducing the LED backlight brightness to the minimum brightness value and increasing the LED backlight brightness to the preset value:

First, reducing the LED backlight brightness to the minimum brightness:

Under such situation, maintaining the LED conduction current to be the predetermined value of the conduction current unvaryingly, and reducing the PWM duty ratio to be the minimum value, thus reducing the LED backlight brightness to the minimum brightness.

Second, increasing the LED backlight brightness to the preset value:

Under such situation, also maintaining the LED conduction current to be the predetermined value of the conduction current unvaryingly, and increasing the PWM duty ratio to be the maximum value, thus increasing the LED backlight brightness from the current LED backlight brightness to the preset value.

Figure 4:
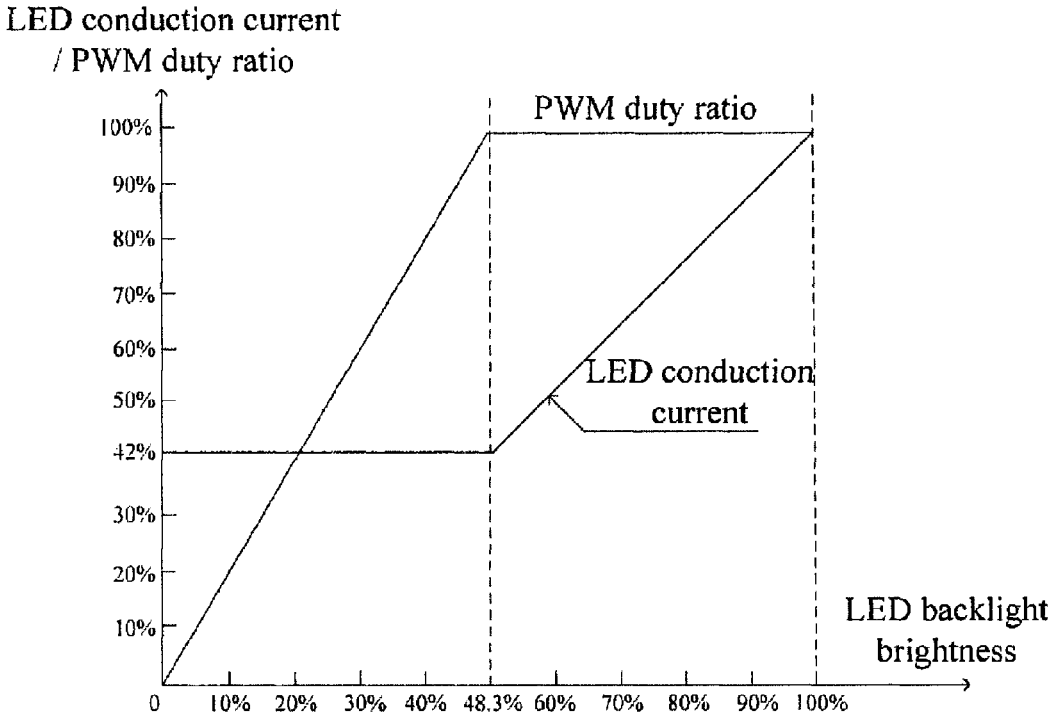
FIG. 4 is a graph showing the adjustment of the LED backlight brightness when the predetermined value of the LED conduction current is chosen to be 42% of the maximum value of actual LED conduction current.

Referring to FIG. 4, FIG. 4 is a graph showing the adjustment of the LED backlight brightness when the predetermined value of LED conduction current is selected to be 42% of the maximum value of actual LED conduction current.

When heightening the LED backlight brightness from 0%, maintaining the LED conduction current to be 42% unvaryingly, and increasing the PWM duty ratio from 0% to 100%, thus increasing the LED backlight brightness from 0% to 48.3%; when further heightening the LED backlight brightness, maintaining the PWM duty ratio to be 100%, and increasing the LED backlight brightness from 48.3% to 100%.

When lowering the LED backlight brightness from 100%, maintaining the PWM duty ratio to be 100%, and reducing the LED conduction current from 100% to 42%, thus reducing the LED backlight brightness from 100% to 48.3%; when further lowering the LED backlight brightness, maintaining the LED conduction current to be 42% unvaryingly, and reducing the PWM duty ratio from 100% to 0%, thus reducing the LED conduction current from 48.3% to 0%.

FIG. 4 is only an example for ease of appreciation, so the maximum value of the PWM duty ratio needs not be 100%, and the minimum value needs not be 0%; accordingly, the maximum value of the backlight brightness needs not be 100%, and the minimum value of that needs not be 0%.

Figure 5:
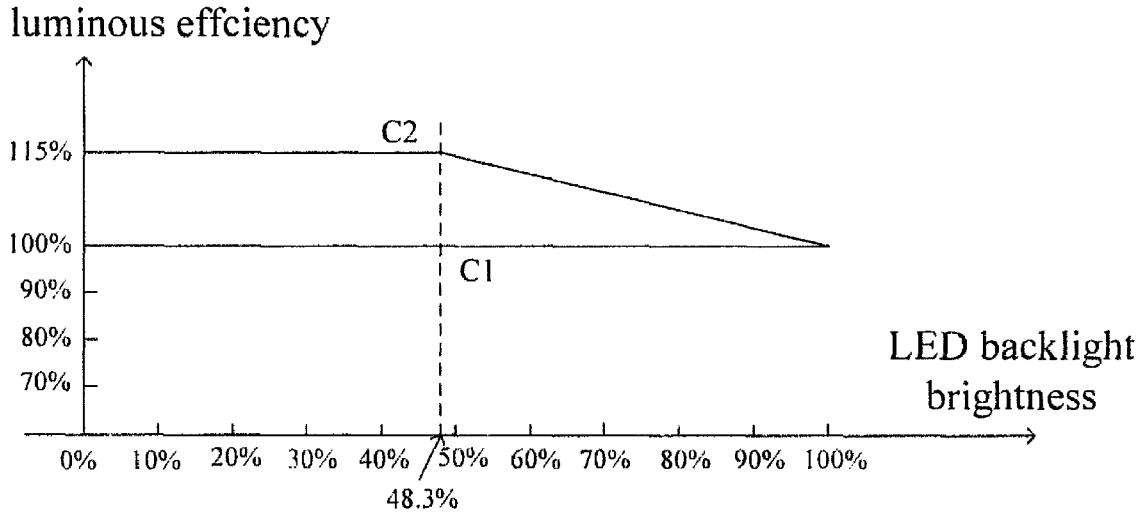
FIG. 5 is a comparison chart of the LED luminous efficiency.

Referring to FIG. 5, FIG. 5 is a comparison chart of the LED luminous efficiency. In the figure, C1 represents the LED luminous efficiency which keeps at 100% when only adopting the PWM dimming in prior art; C2 represents the LED luminous efficiency which climbs from 100% to 115% when adopting the mixing dimming in the present disclosure. Obviously, the adjustment method for LED backlight brightness in the present disclosure greatly improves the LED luminous efficiency.

Comparing with the prior art, the adjustment method for LED backlight brightness in the present disclosure allows the LED conduction current not always keep at the maximum value by means of choosing PWM dimming or the conduction current dimming according to the current LED backlight brightness, which greatly improves the LED luminous efficiency and reduces backlight loss. Moreover, when the LED backlight brightness is greater than the preset value, the conduction current dimming (i.e. analogue dimming) is adopted, which can avoid noise produced by the LED drive circuit; and when the LED backlight brightness is not greater than the preset value, the PWM dimming is adopted, in this case, the LED conduction current is at the preset value rather than the maximum value, which can also avoid noise produced by the LED drive circuit.

What described above are only preferred embodiments of the present disclosure but are not intended to limit the scope of the present disclosure. Accordingly, any equivalent structural or process flow modifications that are made on basis of the specification and the attached drawings or any direct or indirect applications in other technical fields shall also fall within the scope of the present disclosure.

What is claimed is:

1. An adjustment method for LED backlight brightness, comprising the following steps of: when the current LED backlight brightness is greater than a preset value, maintaining PWM duty ratio to be a maximum value, and adjusting the LED backlight brightness by adjusting an LED conduction current; and when the current LED backlight brightness is not greater than the preset value, maintaining the LED conduction current to be constant, and adjusting the LED backlight brightness by adjusting the PWM duty ratio to be changed between the maximum value and a minimum value.

2. The adjustment method for LED backlight brightness according to claim 1, wherein the preset value is any value within a range of 36%~84% of the maximum brightness of the LED backlight.

3. The adjustment method for LED backlight brightness according to claim I, wherein the maximum value of the PWM duty ratio is a value within a range of 80%~100%.

4. The adjustment method for LED backlight brightness according to claim 1, wherein the preset value is a brightness value of the LED backlight corresponding to the LED conduction current which is at a predetermined value, and the predetermined value of the LED conduction current is determined by the variation characteristics of LED chromaticity coordinate and luminous efficiency.

5. The adjustment method for LED backlight brightness according to claim 4, wherein the predetermined value of the LED conduction current is any value within a range of 30%~80% of the maximum value of actual LED (i.e. LED in actual work) conduction current.

6. The adjustment method for LED backlight brightness according to claim 4, wherein the predetermined value of the LED conduction current is 42% of the maximum value of actual LED conduction current.

7. The adjustment method for LED backlight brightness according to claim 4, wherein the preset value is any value within 36%~84% of the maximum brightness of the LED backlight.

8. The adjustment method for LED backlight brightness according to claim 7, wherein the preset value is 48.3% of the maximum brightness of the LED backlight.

9. The adjustment method for LED backlight brightness according to claim 4, wherein the step of said when the current LED backlight brightness is greater than a preset value, maintaining the PWM duty ratio to be a maximum value, and adjusting the LED backlight brightness by adjusting an LED conduction current comprises: if the current LED backlight brightness is greater than a preset value, when increasing the LED backlight brightness to the maximum value, maintaining the PWM duty ratio to be the maximum value, and increasing the LED conduction current to the maximum value of actual LED conduction current; and when reducing the LED backlight brightness to the preset value, maintaining the PWM duty ratio to be the maximum value, and reducing the LED conduction current to the preset value of the conduction current.

10. The adjustment method for LED backlight brightness according to claim 4, wherein the maximum value of the PWM duty ratio is a value within a range of 80%~100%.

11. The adjustment method for LED backlight brightness according to claim 4, wherein the minimum value of the PWM duty ratio is a value within a range of 0%~30%.

12. The adjustment method for LED backlight brightness according to claim 4, wherein the step of said when the current LED backlight brightness is not greater than the preset value, maintaining the LED conduction current to be constant, and adjusting the LED backlight brightness by adjusting the PWM duty ratio to be changed between the maximum value and a minimum value comprises: if the current LED backlight brightness is not greater than a preset value, when reducing the LED backlight brightness to the minimum value, maintaining the LED conduction current to be the predetermined value of the conduction current, and reducing the PWM duty ratio to the minimum value; and when increasing the LED backlight brightness to the preset value, maintaining the LED conduction current to be the predetermined value of the conduction current, and increasing the PWM duty ratio to the maximum value of the PWM duty ratio.

13. The adjustment method for LED backlight brightness according to claim 12, wherein the minimum value of the PWM duty ratio is a value within a range of 0%~30%.

* * * * *